US005374055A

United States Patent [19]

Tung

[11] Patent Number: 5,374,055

[45] Date of Patent: Dec. 20, 1994

[54] FOLDABLE GOAL HOOP OF BASKET BALL

[76] Inventor: Chiang C. Tung, 122, Shoei Nan Road, Taichung, Taiwan, Prov. of China

[21] Appl. No.: 239,394

[22] Filed: May 6, 1994

[51] Int. Cl.[5] ..... A63B 63/08

[52] U.S. Cl. ..... 273/1.5 R; 16/328

[58] Field of Search ..... 273/1.5 R, 1.5 A; 248/240–240.4, 291; 16/319, 321, 322, 327–334, 352, 353

[56] References Cited

U.S. PATENT DOCUMENTS

| | | | |
|---|---|---|---|
| 1,633,281 | 6/1927 | Nielsen | 16/332 X |
| 1,732,508 | 10/1929 | Farris | 16/331 X |
| 2,596,543 | 5/1952 | Fox | 273/1.5 R |
| 2,746,664 | 5/1956 | Struic | 248/240 X |
| 2,905,424 | 9/1959 | Snow | 248/240.4 |
| 3,788,642 | 1/1974 | Matras et al. | 273/1.5 R |
| 3,820,784 | 6/1974 | Boitano et al. | 273/1.5 R |
| 3,851,354 | 12/1974 | Anderson | 16/331 |
| 4,987,976 | 1/1991 | Daugherty | 16/331 X |
| 5,098,108 | 3/1992 | McKinney | 273/1.5 R X |
| 5,232,260 | 8/1993 | Lippard | 16/328 X |

FOREIGN PATENT DOCUMENTS

| | | | |
|---|---|---|---|
| 171128 | 11/1921 | United Kingdom | 16/331 |
| 1468656 | 3/1977 | United Kingdom | 16/328 |
| 538122 | 12/1976 | U.S.S.R. | 16/331 |

*Primary Examiner*—Paul E. Shapiro

*Attorney, Agent, or Firm*—Charles E. Baxley

[57] ABSTRACT

A foldable goal hoop of basket ball is composed of a fastening member, a movable member and a predetermined number of retaining bodies. The fastening member and the movable member are joined together by means of a pivot. The movable member is provided with two folding sides for reinforcing the structural strength of the movable member. The retaining bodies are used to hold securely the movable member at such time when the goal hoop is folded or in use.

4 Claims, 5 Drawing Sheets

FOLDABLE GOAL HOOP OF BASKET BALL

BACKGROUND OF THE INVENTION

The present invention relates generally to a goal basket of basket ball, and more particularly to a foldable goal hoop of basket ball.

Generally speaking, the basket ball goal hoop is fixed to the backboard such that the goal hoop is perpendicular to the backboard. There is nothing wrong with such a basket ball goal hoop as described above. However, from the manufacturer's point of view, an improvement is called for in view of the fact that the basket ball goal hoop is relatively large in size and that its packaging and shipping costs are therefore relatively expensive. Needless to say, the packaging and the shipping costs can be reduced if the size of the basket ball goal hoop can be menaingfully reduced. The reduction in size of the basket ball goal hoop can be attained by making the goal hoop foldable. There are foldable basket ball goal hoops already available in the market; nevertheless they are for use as toys by children.

SUMMARY OF THE INVENTION

It is therefore the primary objective of the present invention to provide a foldable basket ball goal hoop, which is simple and yet strong in construction.

It is another objective of the present invention to provide a foldable basket ball goal hoop, which is relatively small in size and can be therefore packaged and shipped at a low cost.

It is still another objective of the present invention to provide a foldable basket ball goal hoop, which is so structurally reinforced as to prevent the bending or the breakage of the hoop by an impact force.

It is still another objective of the present invention to provide a foldable basket ball goal hoop, which can be located securely and folded quickly.

In keeping with the principles of the present invention, the foregoing objectives of the present invention are attained by a foldable basket ball goal hoop, which comprises mainly a fastening member, a movable member, and a predetermined number of retaining bodies.

The fastening member is made integrally and fastened to a backboard. Provided respectively to both sides of the fastening member is a folding side provided with two retaining holes, one mounting hole, and a predetermined number of pivoting rings, each of which is contiguous to an urging block.

The movable member is made integrally and used for fastening the goal hoop. The movable member is provided with a predetermined number of pivoting rings, which are joined with the pivoting rings of the fastening member by means of a pivot.

The retaining bodies are fastened to the movable member such that they are contiguous to the pivoting rings, and that they can be caused to enter the retaining holes of the fastening member so as to ensure that the goal hoop is folded or unfolded securely. When the goal hoop is in use, each of the retaining bodies is urged by the urging block so that the goal hoop can be held securely and horizontally.

The foregoing objectives, features and advantages of the present invention can be more readily understood upon a thoughtful deliberation of the following detailed description of the present invention in conjunction with the accompanying drawings.

DETAILED DESCRIPTION OF THE INVENTION

Figure 1:
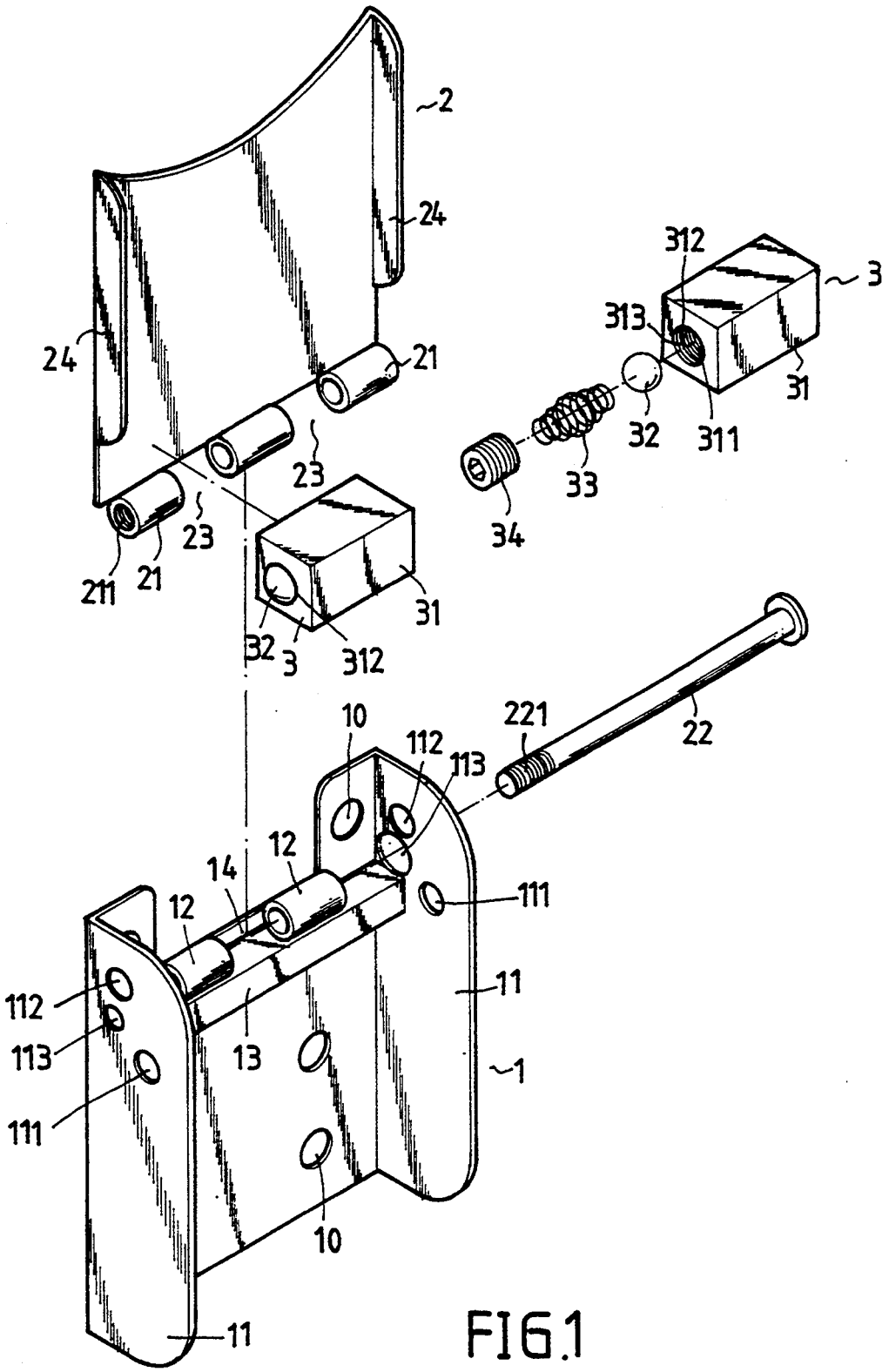
FIG. 1 shows an exploded view of the present invention.
Figure 2:
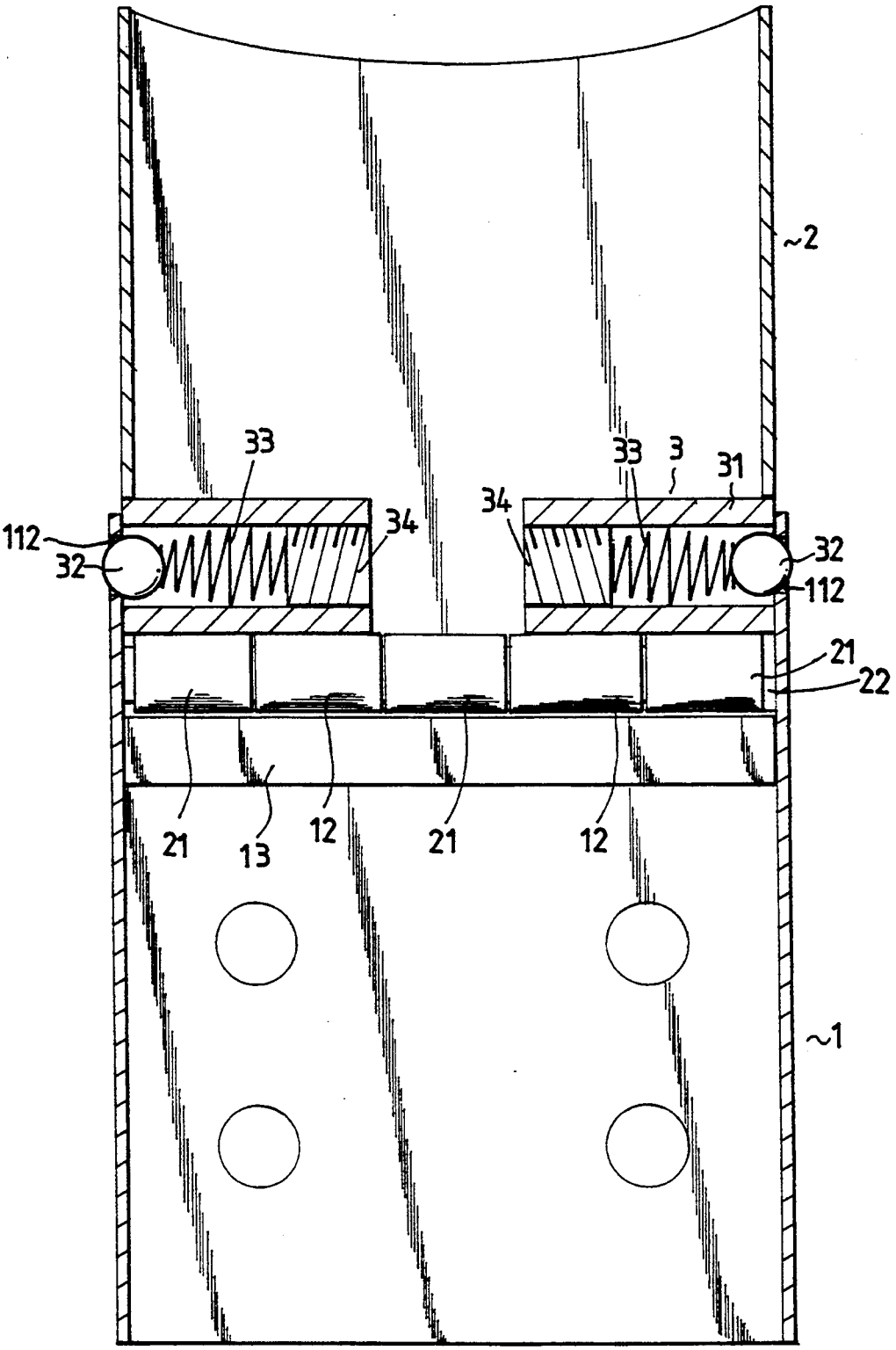
FIG. 2 shows a schematic plan view of the present invention in combination.
Figure 3:
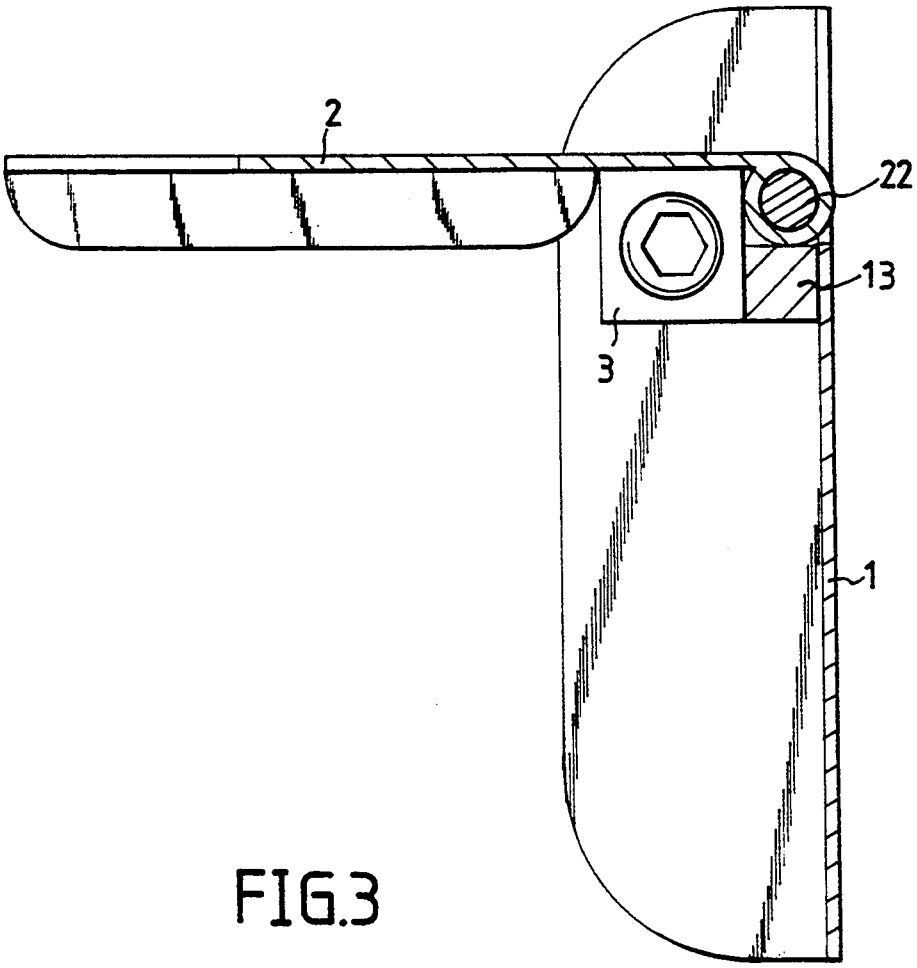
FIG. 3 shows a longitudinal sectional view of the present invention in combination.

As shown in all drawings provided herewith, a foldable goal hoop of basket ball of the present invention comprises .a fastenign member 1, a movable member 2, and a predetermined number of retaining bodies 3.

The fastening member 1 is made integrally and fastened to a backboard 4. The fastening member 1 is provided respectively on both sides thereof with a folding side 11 having two retaining holes 111 and 112, one mounting hole 113, and a predetermined number of pivoting rings 12 which are made integrally. Located contiguously to the pivoting rings 12 is an urging block 13.

The movable member 2 is made integrally for fastening a goal hoop 5 and provided with a are corresponding in location to gaps 14 formed between the two pivoting rings 12 of the fastening member 1. In other words, the pivoting rings 21 of the movable member 2 and the pivoting rings 12 of the fastening member 1 are located respectively in the gaps 14 and 23 such that the pivoting rings 12 and 21 can be mounted rotatably on a pivot 22 which is received in the mounting holes 113 of the fastening member 1. The movable member 2 is provided additionally and respectively on both sides thereof with a folding side 24 for reinforcing the structure of the movable member 2. In order to ensure that the fastening member 1 and the movable member 2 are pivoted securely, one of the pivoting rings 21 of the movable member 2 is provided therein with female threads 211 engageable with male threads 221 of the pivot 22, as shown in FIG. 1.

The retaining bodies 3 are fastened to the movable member 2 such that they are contiguous to the pivoting rings 21. Each of the retaining bodies 3 is composed of a main body 31, a locating ball 32, a compression spring 33 and a threaded rod 34. The main body 31 is provided axially a through hole 311 having two end openings 312 similar in dimension. The through hole 311 is provided therein at one end thereof with female threads 313 and dimensioned to receive movably therein the locating ball 32 having a diameter slightly smaller than an inner diameter of the through hole 311. The compression spring 33 is also received in the through hole 311 such that the compression spring 33 is in contact at one end thereof with the locating ball 32. Both locating ball 32 and the compression spring 33 are kept securely in the through hole 311 by means of the threaded rod 34 engaging the female threads 313 of the through hole 311. The locating ball 32 can be forced at an appropriate time into the retaining holes 111 and 112 of the fastening member 1, so as to ensure that the goal hoop, 5 is folded securely or held securely in a working position. In addition, when the goal hoop 5 is in use, each of the retaining bodies 3 is urged by the urging block 13 of the fastening member I so that the goal hoop 5 is held securely in a horizontal position.

Figure 4:
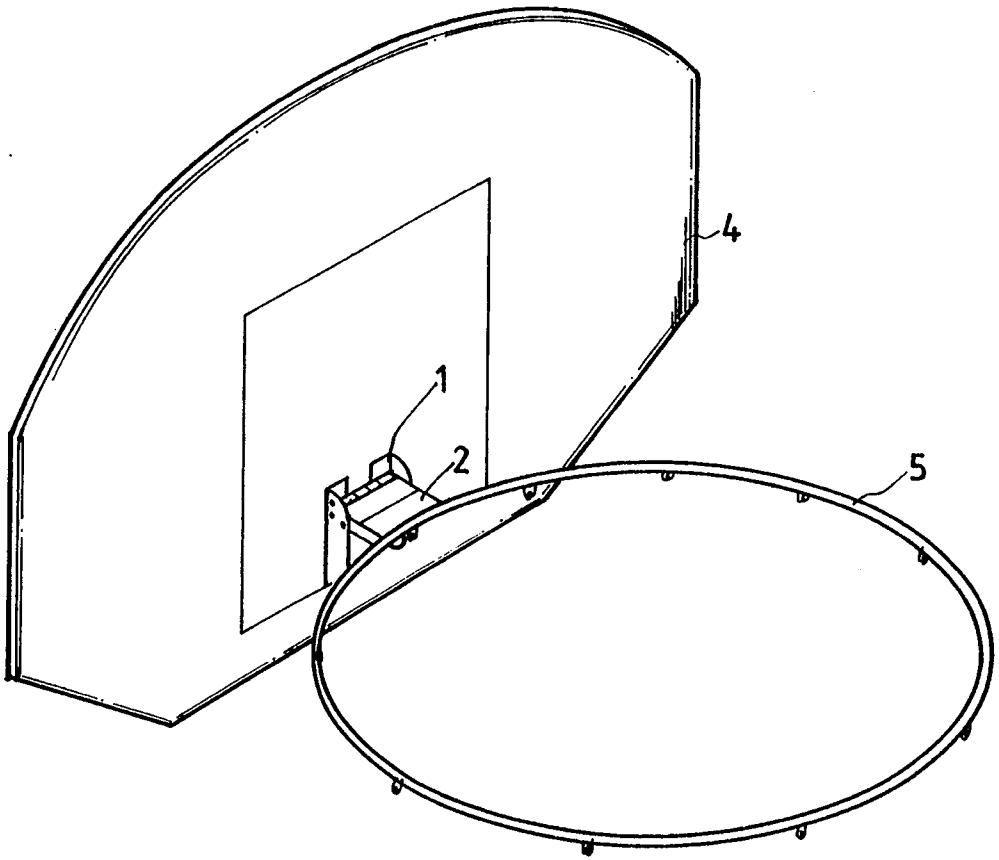
FIG. 4 shows a perspective view of the present invention in use.
Figure 5:
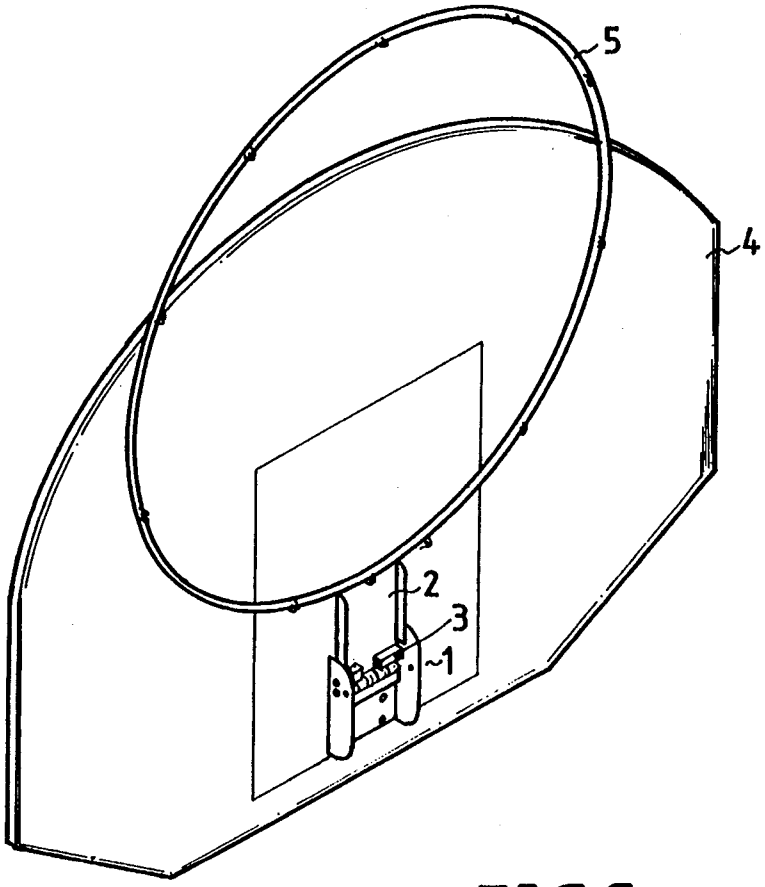
FIG. 5 shows a perspective view of the present invention in a folded state.

As the goal hoop 5 is folded, the locating ball 32 is forced by the elastic force of the compression spring 33 to move into the retaining hole 112 so as to ensure that the goal hoop 5 is folded securely. On the other hand, as the goal hoop 5 is unfolded to put into use, the locating ball 32 is forced, by the elastic force of the compression spring 33 to move into another retaining hole 111 of the fastening member 1. In the meantime, each of the retaining bodies 3 is urged by the urging block 13 of the fastening member 1 so as to hold the goal hoop 5 securely in a horizontal position, as shown in FIG. 4. The retaining effect of the present invention can be reinforced by tightening the threaded rod 34 or by using a stronger compression spring 33. It must be noted here that the goal hoop 5 can not be folded easily if the threaded rod 34 is tightened excessively. However, such a minor mishap can be overcome easily by loosening the threaded rod 34 appropriately.

The through hole 311 of the main body 31 of the present invention is of a straight construction. As a result, the locating ball 32 can be directly and effectively exerted on by the elastic force of the compression spring 33 so that the locating ball 32 can be forced into the retaining holes 111 and 112 without difficulty. In other words, the goal hoop 5 can be folded securely or held securely in a working position.

Figure 6:
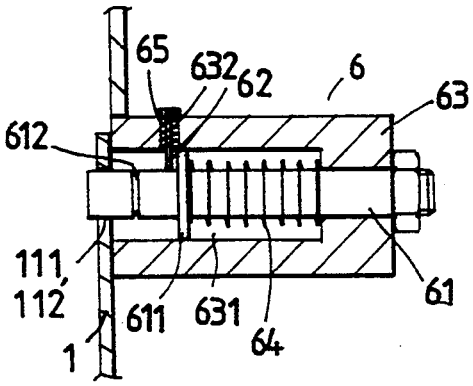
FIG. 6 is a schematic view showing that the retaining body and the fastening member are held securely to each other, according to another preferred embodiment of the present invention.

Another embodiment of the present invention is illustrated in FIG. 6 in which a modified retaining body 6 is shown comprising a main body 63 provided with a through hole 631 and two locking bodies 61 and 62 in place of the locating ball 32. The through hole 631 has one segment with an inner diameter smaller than an inner diameter of another segment thereof. A compression spring 64 is disposed in the segment having the greater inner diameter, with the compression spring 64 being fitted over the locking body 61 such that one end of the compression spring 64 is stopped by an annular protuberance 611 of the locking body 61. In order to facilitate one end of the locking body 61 to emerge from the main body 63 so as to be held with hand, the locking body 61 is provided with an annular locating slot 612. The main body 63 is further provided with a hole 632 which another locking body 62 and a spring 65 are received. The locking body 62 can be forced by the elastic force of the spring 65 to move into the locating slot 612 of the locking body 61. Under a normal condition, the locking body 62 is retained in the locating slot 612 of the locking body 61 whose front end is caused to remain inside the main body 63. In the meantime, the fastening member 1 and the movable member 2 are not retained in any way and can be therfore rotated relatively. In the process of locating securely the goal hoop 5 in a folded position or in a working position, the locking body 62 is drawn out to disengage the locating slot 612. In the meantime, the locking body 61 is forced by the elastic force of the compression spring 64 to move back to its original position. In other words, the locking body 61 is caused to move into the retaining holes 111 and 112 of the fastening member 1. The retaining effect of the present invention can be better attained by means of the locking bodies 61 and 62 in place of the locating ball 32 which can be accidentally caused to turn to move out of a locating position.

The embodiments of the present invention described above are to be regarded in all respects as merely illustrative and not restrictive. Accordingly, the present invention may be embodied in other specific forms without deviating from the spirit thereof The present invention is therefore to be limited only by the scope of the following appended claims.

What is claimed is:

1. A foldable basket ball goal hoop comprising:

a fastening member made integrally for fastening to a backboard and provided with two folding sides opposite to each other and having respectively two retaining holes, one mounting hole, and a predetermined number of pivoting rings, said fastening member further provided with an urging block contiguous to said pivoting rings;

a movable member made integrally for fastening a foldable basket ball goal hoop and provided with a predetermined number of pivoting rings mounted rotatably on a pivot on which said pivoting rings of said fastening member are mounted rotatably; and a predetermined number of retaining bodies which are so disposed that said retaining bodies contiguous to said pivoting rings of said movable member, and that said retaining bodies can be caused to move into said retaining holes of said fastening member at such time when said goal hoop is folded or in use, and further that said retaining bodies are urged by said urging block of said fastening member so as to keep said goal hoop securely in a horizontal position.

2. The foldable basket ball goal hoop of claim 1 where in each of said retaining bodies comprises:

a main body provided longitudinally with a straight through hole having both end openings similar in dimension and having one end provided therein with female threads;

a locating ball received rotatably in said through hole;

a compression spring received in said through hole such taht one end of said compression spring urges said locating ball; and a threaded rod engageable with said female threads of said through hole of said main body.

3. The foldable basket ball goal hoop of claim 1 wherein said movable member is provided with two reinforcing folding sides opposite to each other and made integrally with said movable member.

4. The foldable basket ball goal hoop of claim 1 wherin each of said retaining bodies comprises:

a main body provided longitudinally with a through hole having one segment with an inner diameter smaller than an inner diameter of another segment thereof, said main body further provided with a hole;

a first biasing means received in said another segment of said through hole of said main body;

a first locking body provided with an annular protuberance and an annular locating slot, said first locking body being fitted into said first biasing means such that said annular protuberance of said first locking body is urged by one end of said first biasing means, said annular locating slot enabling a portion of said first locking body to remain in the outside of said main body such that one end of said first locking body can be caused to move into said retaining holes of said fastening member and that another end of said first locking body can be held with hand;

a second biasing means received in said hole of said main body; and a second locking body being fitted into said second biasing means, in a normal state, said second locking body put into said annular locating slot of said first locking body by the elastic force of said second biasing means.

* * * * *